US005909804A

United States Patent [19]

Kuratani

[11] Patent Number: 5,909,804

[45] Date of Patent: Jun. 8, 1999

[54] DEPRESSION ACTIVATED SWITCH

[75] Inventor: Junichi Kuratani, Miyagi-ken, Japan

[73] Assignee: Alps Electric Co., Ltd., Japan

[21] Appl. No.: 08/917,791

[22] Filed: Aug. 18, 1997

[30] Foreign Application Priority Data

Aug. 29, 1996 [JP] Japan ..... 8-228388

[51] Int. Cl.[6] ..... H01H 13/70

[52] U.S. Cl. ..... 200/516; 200/513; 200/406

[58] Field of Search ..... 200/516, 517, 200/512, 513, 521, 342, 406

[56] References Cited

U.S. PATENT DOCUMENTS

| | | | |
|---|---|---|---|
| 4,127,752 | 11/1978 | Lowthorp | 200/516 X |
| 4,933,522 | 6/1990 | Celander | 200/516 X |
| 5,149,923 | 9/1992 | Demeo | 200/512 X |
| 5,199,557 | 4/1993 | Brandt et al. | 200/406 |
| 5,664,667 | 9/1997 | Kenmochi | 200/512 X |

FOREIGN PATENT DOCUMENTS 60-50825 3/1985 Japan .

*Primary Examiner*—Renee S. Luebke

*Attorney, Agent, or Firm*—Brinks Hofer Gilson & Lione

[57] ABSTRACT

A depression actuated switch which is suitable for achieving a reduction thickness and which does not easily malfunction even when an end depressing operation is performed thereon includes: a driving member 4 having a depressing portion 4*a* and a mounting portion 4*b* which are connected together by an elastic portion 4*c* that is elastically deformable during operation; a sheet-like flexible member 2 to the lower surface of which the mounting portion 4*b* of the driving member 4 is attached; a cushion member 3 which is positioned so as to surround the driving member 4, to the upper surface of which the sheet-like flexible member 2 is glued and which is more liable to be elastically deformed than the sheet-like flexible member 2; a click spring 5 which is arranged below the depressing portion 4*a* of the driving member 4 and which generates a tactile click feel when it flips over; and a membrane switch 6 arranged below this click spring 5 and which effects conduction between contacts by the click spring 5 which has flipped over.

6 Claims, 4 Drawing Sheets

DEPRESSION ACTIVATED SWITCH

BACKGROUND OF THE INVENTION

1. Field of the Invention

The present invention relates to a depression-type switch which generates a tactile "click" feel when it is turned on by depressing a key top or the like and which is designed to provide an overstroke, making it possible to further push in the key top or the like even after the switch has been turned on.

2. Description of the Related Art

In such a depression-type switch, a tactile click feel is transmitted to the finger of the operator when the key top is pushed in by a predetermined stroke, so that the operator can clearly feel with his finger that the switch has been turned on. Further, the stroke is not at an end immediately after the turning on of the switch but some more stroke (overstroke) is provided, so that an uncomfortable impact is not easily transmitted to the finger of the operator. Thus, a satisfactory operating feel can be expected. Further, the structure of the switch is relatively simple. Thus, nowadays, the switch is widely used in various fields.

FIG. 8 is a sectional view showing a conventional depression-type switch of this sort. As shown in the drawing, which schematically shows the construction of the switch, the depression-type switch, which is fitted in an opening 20*a* of a frame 20, includes a key top 11, a rubber spring 12, a coil spring 13 which is provided between the key top 11 and the rubber spring 12, and a membrane switch 14 which is provided underneath the rubber spring 12. The wall portion 12*a* of the rubber spring 12, which has a bowl-shaped configuration, is deformed (flips over) when pushed in from above by a predetermined amount, thereby generating a tactile click feel. The membrane switch 14 includes a flexible upper sheet 15, an upper electrode 16, which is provided on the lower side of the upper sheet 15, a lower sheet 17, lower electrodes 18 which are provided on the upper side of the lower sheet 17, and a spacer 19 which is provided between the sheets 15 and 17 and which has an opening 19*a*, the upper and lower electrodes 16 and 18 being capable of being brought into and out of contact with each other within the opening 19*a*.

In this construction, as the operator pushes in the upper surface of the key top 11 downwardly with the finger, the coil spring 13 is compressed by degrees, with the result that it increases in bounce. When the bounce of the coil spring 13 has reached a certain level, the rubber spring 12 flips over. When the rubber spring 12 flips over, the depressing protrusion 12*b* thereof pushes in the upper sheet 15 of the membrane switch 14 to thereby deflect it downwards, so that the upper electrode 16 is brought into contact with the lower electrodes 18, whereby the switch is turned on. Further, when the rubber spring 12 flips over, the bounce applied to the key top 11 through the coil spring 13 abruptly decreases, with the result that a tactile click feel is transmitted to the finger of the operator. Even after the rubber spring 12 has thus flipped over, the coil spring 13 can be compressed, so that the operator can further push in the key top by some amount while feeling the bounce increasing by degrees, whereby a satisfactory overstroke can be obtained. In this condition, when the push-in force of the finger applied to the key top 11 is cancelled, the rubber spring 12 is restored to its original bowl-shaped configuration, so that the deflection of the upper sheet 15 is cancelled. Thus, the upper electrode 16 is separated from the lower electrodes 18, thereby restoring the switch to the OFF state. At the same time, the key top 11 is pushed upward to the original height by the restoring force of the coil spring 13 and the rubber spring 12.

A specific example of such a depression-type switch is disclosed in Japanese Patent Laid-Open No. 60-50825, etc.

In the conventional depression-type switch described above, the rubber spring 12 having an appropriate height is mounted on a switch element, such as the membrane switch 14. Further, the coil spring 13 has to be mounted between the rubber spring 12 and the key top 11 so as to be capable of vertically expanding and contracting. Thus, it is rather difficult to form a thin switch whose general height is small. Further, in such a conventional switch, when an end depressing operation is performed by the operator, that is, when a peripheral portion of the upper surface of the key top 11 is depressed, the coil spring 13, which is inclined by such operation, is liable to be compressed unevenly, so that there is a concern that the switch will not operate in the normal fashion.

SUMMARY OF THE INVENTION

In accordance with the present invention, a driving member for pushing in a click spring is held by elastically deformable holding means and, after the click spring has flipped over, a part of the driving member is elastically deformed. By adopting this construction, there is no need to stack the coil spring and the rubber spring one upon the other, and it is possible to achieve a satisfactory tactile click feel and overstroke while facilitating a reduction in thickness. Further, the switch is not liable to malfunction even if an end depressing operation is performed thereon, thereby achieving an improvement in terms of reliability.

In accordance with the present invention, there is provided a depression-type switch comprising: a driving member having a depressing portion and a mounting portion which are connected by an elastic portion that is elastically deformable during operation; holding means to which the above-mentioned mounting section of the driving member is mounted and which is elastically deformable during operation; a click spring which is arranged below the above-mentioned depressing portion of the above-mentioned driving member and which generates a tactile click feel when flipping over; and a switch element which is arranged below the click spring and which effects conduction between contacts by the click spring that has flipped over. The above-mentioned holding means is preferably composed of a sheet-like flexible member to the lower surface of which the above-mentioned mounting portion of the above-mentioned driving member is mounted and a cushion member which is positioned so as to surround the above-mentioned driving member, on the upper surface of which the above-mentioned sheet-like flexible member is stacked by gluing or the like, and which consists of a foam member or the like that is more liable to be elastically deformed than the above-mentioned sheet-like flexible member.

When this depression-type switch, constructed as described above, is depressed, the driving member is lowered by degrees while elastically deforming the above-mentioned holding means. After the above-mentioned depressing portion has pushed in the above-mentioned click spring and caused it to flip over, the lowering of the above-mentioned depressing portion is restricted, so that, as the above-mentioned mounting portion is lowered, the above-mentioned elastic portion is elastically deformed, whereby an overstroke is obtained. Thus, it is possible to achieve a tactile click feel and overstroke with a simple structure, and it is possible to incorporate a click spring consisting of a thin metal plate or the like and the above-mentioned driving member, which have a small height dimension, instead of a rubber spring and a coil spring, whereby a reduction in thickness can be easily achieved.

Further, in this depression-type switch, even when an end depressing operation is performed on the above-mentioned driving member, the above-mentioned holding means (the sheet-like flexible member, the cushion member, etc.) are integrally pushed down with the driving member in the portion where the end depressing operation has been performed, so that there is no concern that the driving member will be greatly inclined toward the end depression side, whereby it is possible to reliably cause the click spring to flip over by the above-mentioned depressing portion by a predetermined stroke.

The above-mentioned driving member of this depression-type switch may consist of one in which the depressing portion and the mounting portion are partially connected to each other to form an elastic portion or one in which the section between the depressing portion and the mounting portion is formed as a thin-walled section constituting an elastic portion. In particular, in the former, it is possible to provide a desired flexibility to effect elastic deformation for overstroke on the elastic portion even when the elastic portion partially connecting the depressing portion and the mounting portion together is formed as a thick-walled section, so that the elastic portion is not easily subject to damage even in the case of a long-term use, whereby an increase in the service life of the driving member can be achieved.

When the depressing portion is provided substantially at the center of the above-mentioned driving member of this depression-type switch, and the mounting portion is provided around this depressing portion, the depressing portion becomes less subject to inclination during depressing operation, so that the above-mentioned click spring is less likely to be obliquely pushed in, whereby an increase in service life is achieved and, consequently, it is possible to generate a satisfactory tactile click feel for a long period of time.

DESCRIPTION OF THE PREFERRED EMBODIMENT

Figure 1A:
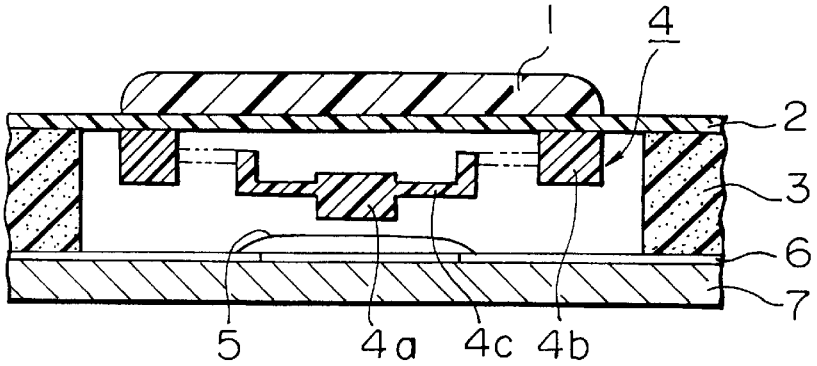
FIGS. 1A through 1D are diagrams illustrating the operation of a depression-type switch according to an embodiment of the present invention.

In the drawings FIG. 1—FIG. 4 indicate a key top formed of a UV curing resin or the like; numeral 2 indicates a sheet-like flexible member which is formed of a film sheet material, such as PET (polyethylene terephthalate) or PEN (polyethylene naphthalate), and to the upper surface of which the key top 1 is firmly attached; numeral 3 indicates a cushion member which consists of a foam material, such as urethane foam or silicone foam, and to the upper surface of which the sheet-like flexible member 2 is attached; numeral 4 indicates a driving member which is formed of a synthetic resin, such as polypropylene, polycarbonate or polyacetal, or a hard rubber, such as elastomer; numeral 5 indicates a dome-shaped click spring which consists of a metal thin plate of phosphor bronze, stainless steel or the like and which generates a tactile click feel when it flips over; numeral 6 indicates a membrane switch in which an upper electrode that is provided on the lower side of a flexible upper sheet formed of PET or the like is opposed to a lower electrode that is provided on the upper side of a lower sheet within the opening of a spacer; and numeral 7 indicates a base plate which consists of an iron plate, a phenol resin plate or the like and on which the membrane switch 6 is placed for fixation.

Figure 2:
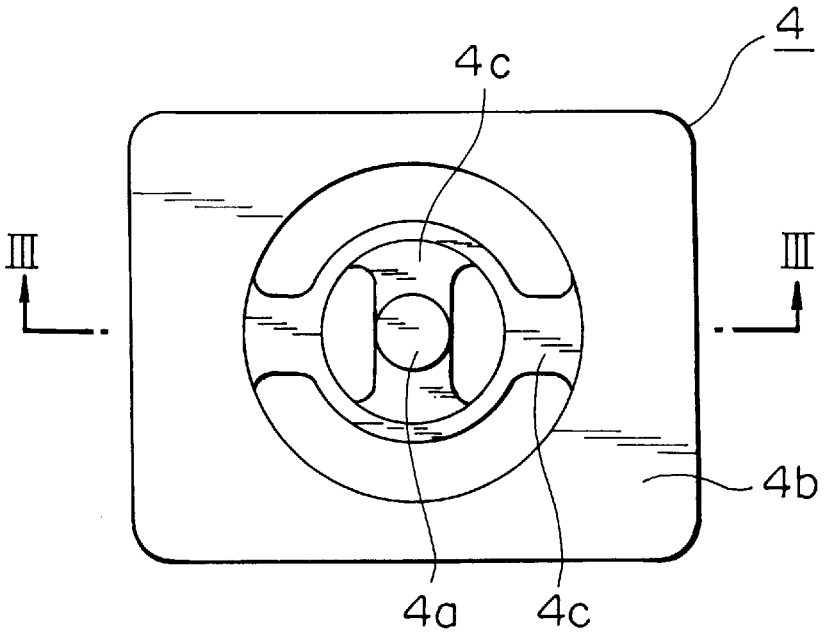
FIG. 2 is a plan view of a driving member with which the depression-type switch is equipped.
Figure 3:
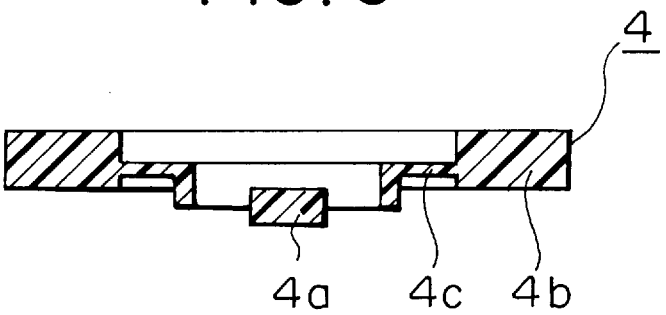
FIG. 3 is a sectional view taken along the line III—III of FIG. 2.
Figure 4:
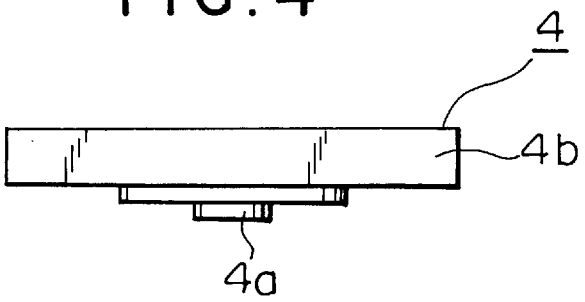
FIG. 4 is a side view of the driving member.

The driving member 4 is composed of a depressing portion 4*a* for pushing in the click spring 5 and causing it to flip over, a mounting portion 4*b* which is glued to the lower side of the sheet-like flexible member 2, and an elastic portion 4*c* which partially connects together the depressing portion 4*a* and the mounting portion 4*b* and which is elastically deformable during operation. This elastic portion 4*c* extends in a direction which is substantially perpendicular to the operating direction of the depression-type switch (i.e., a direction which is substantially parallel to the plane of the sheet-like flexible member 2), and, as shown in FIG. 2, is designed such that the depressing portion 4*a* and the mounting portion 4*b* of the driving member 4 do not overlap each other as seen in plan view. The sheet-like flexible member 2, to the lower surface of which the mounting portion 4*b* is attached by an adhesive or an adhesive double coated tape, and the cushion member 3, which is positioned so as to surround the driving member 4 and to the upper surface of which the sheet-like flexible member 2 is attached by an adhesive or an adhesive double coated tape, constitute holding means which is elastically deformable during operation while holding the driving member 4. That is, the driving member 4 is held by the sheet-like flexible member 2 and the cushion member 3 so as to be capable of moving vertically. However, from the viewpoint of the characteristics of the materials, it is to be noted that the cushion member 3, which is formed of a foam material, is more liable to undergo elastic deformation than the sheet-like flexible member 2, which is formed of PET or the like. The above-mentioned membrane switch 6, which is arranged underneath the click spring 5 and which holds the seat portion of the click spring 5 with an adhesive tape (not shown), is designed such that, when the click spring 5 flips over, the upper sheet deflects downwards to thereby cause the upper electrode to come into contact with the lower electrode. In order that the elastic portion 4*c* may be capable of elastic deformation during operation, the depressing portion 4*a* and the elastic portion 4*c* of the driving member 4 are both separated from the sheet-like flexible member 2 in the non-operating state, which is shown in FIG. 1A, and, further, the depressing portion 4*a* protrudes further downward than the mounting portion 4*b* and the elastic portion 4*c*. The cushion member 3, the membrane switch 6 and the base plate 7 are glued to each other by an adhesive or an adhesive double coated tape.

Next, the operation of the depression-type switch, constructed as described above, will be described with reference to FIGS. 1A through 1D. In FIGS. 1A through 1D, the portions indicated by the two-dot chain lines are portions which in reality are not to be seen in these drawings. They are only represented for the purpose of making it easier to see how the elastic portion 4*c* undergoes elastic deformation. Thus, these two-dot chain lines are to be regarded as imaginary lines.

Figure 1B:
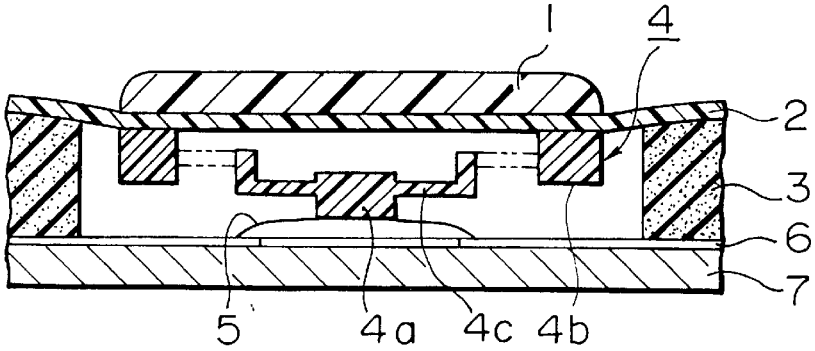
Figure 1C:
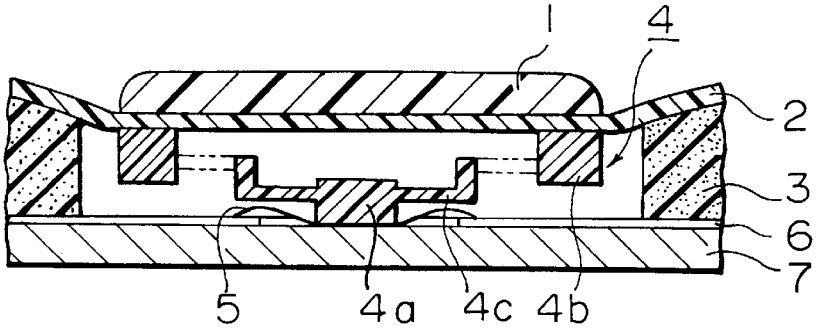
Figure 1D:
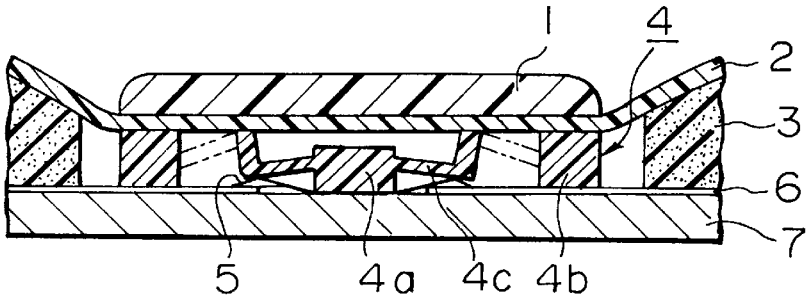

In the condition shown in FIG. 1A, the switch is in the OFF state. When, in this condition, the operator pushes in the upper surface of the key top downwards with the finger, the portion of the sheet-like flexible member 2 around this key top 1 is deflected downward and, at the same time, the cushion member 3 around the driving member 4 contracts by degrees under the load that is applied from the sheet-like flexible member 2, with the result that, as shown in FIG. 1B, the driving member 4 is lowered without changing its overall configuration, and the depressing portion 4*a* comes into contact with the click spring 5. When the key top 1 is further pushed in, and the load applied to the click spring 5 exceeds a predetermined value, the central portion of the click spring flips over by being depressed by the depressing portion 4*a*, with the result that, as stated above, the membrane switch 6 is driven by the click spring 5, resulting in the upper electrode (not shown) coming into contact with the lower electrode (not shown) to thereby turn on the switch. When the click spring 5 has thus flipped over, the descent of the depressing portion 4*a* is restricted, so that, when the key top 1 is further pushed in, the elastic portion 4*c* is elastically deformed with the descent of the mounting portion 4*b*, as shown in FIG. 1D. That is, due to the elastic deformation of the elastic portion 4*c* after the turning on of the switch, an overstroke is obtained. Since the click spring 5 has also elasticity, the elastic portion 4*c* also undergoes, strictly speaking, some elastic deformation during the transition from the state of FIG. 1B to that of FIG. 1C.

When, in the condition shown in FIG. 1D, the push-in force of the finger, which has been applied to the key top 1, is cancelled, the elastic portion 4*c* of the driving member 4, the sheet-like flexible member 2 and the cushion member 3, which have been elastically deformed, are restored to their original configuration due to their own elasticity, so that the key top 1 is pushed upward. As the key top 1 ascends, the click spring 5 is also restored to its original dome-shaped configuration, so that the upper electrode of the membrane switch is separated from the lower electrode to thereby restore the switch to the off state. When the sheet-like flexible member 2 and the cushion member 3 have been restored to the initial that is state shown in FIG. 1A, the ascent of the key top 1 stops.

In the depression-type switch described above, the key top 1 and the driving member 4 are lowered while causing the sheet-like flexible member 2 and the cushion member 3 to undergo elastic deformation. After the depressing portion 4*a* has pushed in the click spring 5 to cause it to flip over, the elastic portion 4*c* undergoes elastic deformation with the descent of the the mounting portion 4*b*. Thus, it is possible to obtain a tactile click feel and an overstroke with a simple structure. Further, in this depression-type switch, there is no need to provide a rubber spring or a coil spring, which have been incorporated in the conventional depression-type switches, so that it is possible to restrain an increase in the general height dimension, thereby making it possible to easily achieve a reduction in thickness. Further, since the depressing portion 4*a* and the mounting portion 4*b* are provided so as not to overlap each other as seen in plan view, it is possible to further restrain an increase in the height of the depression-type switch.

Further, in this depression-type switch, even when an end depressing operation is performed, i.e., even when a peripheral portion of the upper surface of the key top 1 is pushed in, the sheet-like flexible member 2 and the cushion member 3 are pushed down integrally with the driving member 4 in the portion where such an end depressing operation is effected, so that there is no concern that the driving member 4 will be greatly inclined toward the side where the end depressing has been effected. Thus, when the key top 1 is pushed in by a predetermined stroke, it is possible to reliably effect the flipping over of the click spring 5 by the depressing portion 4*a*.

Further, in this depression-type switch, the above-described driving member 4, which consists of the depressing portion 4*a*, the mounting portion 4*b* and the elastic portion 4*c* that partially connects them together, is used, so that, in spite of the fact that the elastic portion 4*c* is formed as a thick-walled section, it is possible to impart a desired flexibility to the elastic portion 4*c* to effect elastic deformation for overstroke. Thus, in this driving member 4, damages, such as cracks, are not easily caused in the elastic portion 4*c* even after a long-term use, thus providing a long-life switch having an excellent durability.

Further, in this depression-type switch, the mounting portion 4*b* is provided so as to surround the depressing portion 4*a* provided substantially at the center of the driving member 4, and the depressing portion 4*a* is supported in a well-balanced state, so that the depressing portion 4*a* is not easily inclined during depressing operation. Thus, there is little concern that the depressing portion will obliquely push in the click spring 5. Thus, an exhaustion of the click spring 5, which would be otherwise liable to occur when the flipping-operation is repeated by oblique depression, can be avoided, and the service life of the click spring can be increased, thereby making it possible to obtain a satisfactory tactile click feel for a long period of time.

While the key top 1 can be formed by curing a UV curing resin applied to the sheet-like flexible member 2, it is also possible for the key top 1 to consist of a mold part and glued to the sheet-like flexible member 2, or a display sheet (not shown) glued to the sheet-like flexible member 2 may be formed into a key top by embossing.

Further, instead of PET or PEN, it is also possible to adopt a thin metal plate of phosphor bronze or the like or a sheet material formed from an urethane foam or the like, which is harder than the cushion member 3, as the material of the sheet-like flexible member 2. When the sheet-like flexible member 2 consists of a transparent film of PET or the like, an opaque display sheet is glued to the surface thereof. When the sheet-like flexible member 2 is a mold part, it may be integrally formed with the key top 1. However, when the depressing position can be clearly indicated by a display sheet or the like, the key top may be omitted.

Further, a material other than a foam material may be used for the cushion member 3. However, to effect a desired elastic deformation at the time of depressing operation, it is desirable to use a foam material whose degree of elasticity can be easily changed with the degree of foaming.

Further, while in the above-described embodiment the sheet-like flexible member 2, the cushion member 3, the membrane switch 6, and the base switch 7 are glued to each other, it is also possible to stack these members together and fasten the peripheral portion of the stacked structure by a clip or the like, thereby integrally forming an integral unit from the sheet-like material 2 through the base plate 7.

Further, there is no need for the cushion member 3 to completely surround the driving member 4 by 360°. The cushion member 3 may be arranged in a partially dispersed form around the driving member 4.

Figure 8:
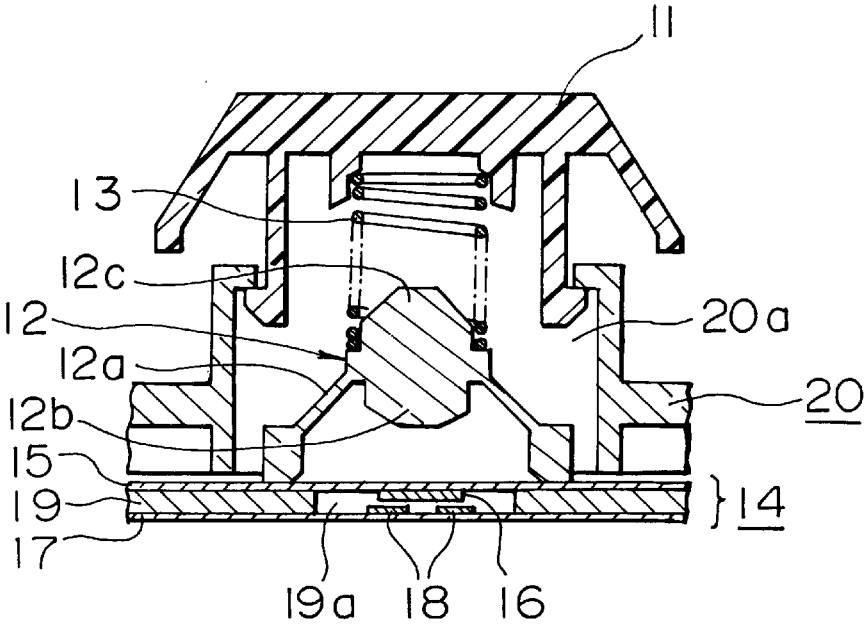
FIG. 8 PRIOR ART
FIG. 8 is a sectional view of a conventional depression-type switch.

Further, while the click spring 5 is generally formed of a thin metal plate, it is also possible to adopt a bowl-like rubber spring as described with reference to the prior art. In this case also, there is no need to provide the protrusion 12*c* (See FIG. 8) for engagement with the coil spring, whereby a general reduction in thickness can be achieved.

Further, instead of the membrane switch 6, it is also possible to use a switch element in which contacts are arranged at positions spaced apart from each other on the same board, conduction being directly effected between these contacts by the click spring 5 when it flips over. That is, in this case, the click spring 5 functions as a movable contact generating a tactile click feel. Apart from the metal thin plate, it is also possible to use a dome-shaped rubber contact as the click spring.

Figure 5:
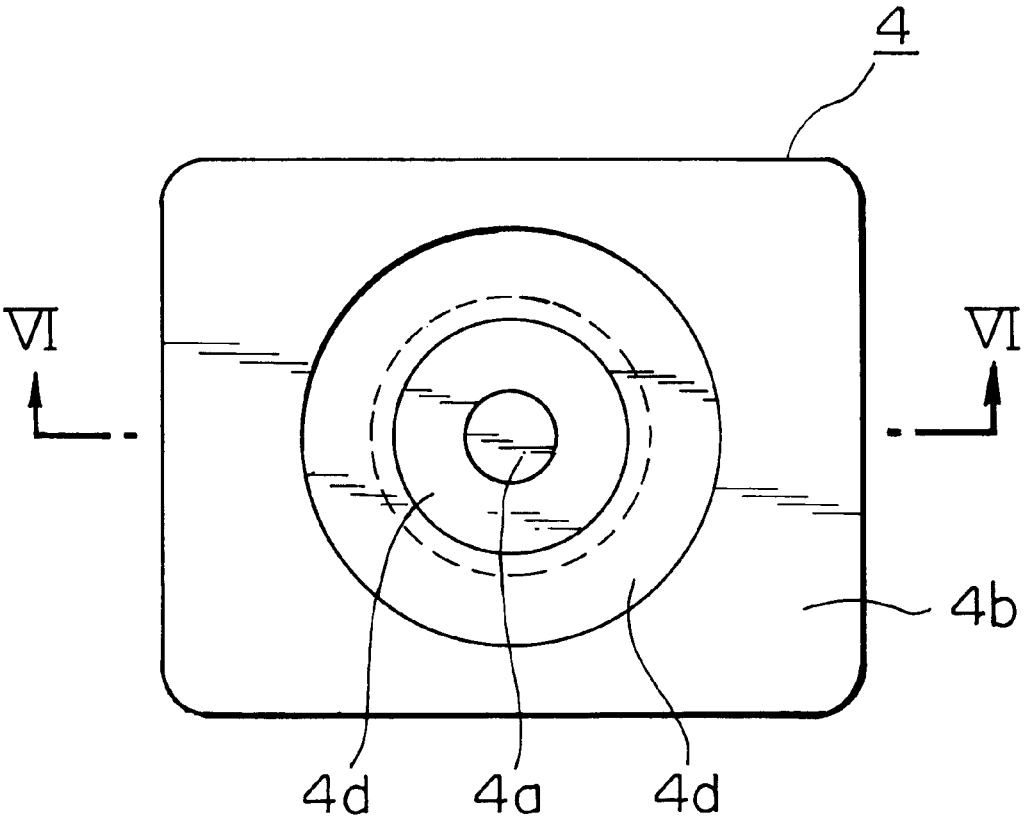
FIG. 5 is a plan view showing a modification of the driving member.
Figure 6:
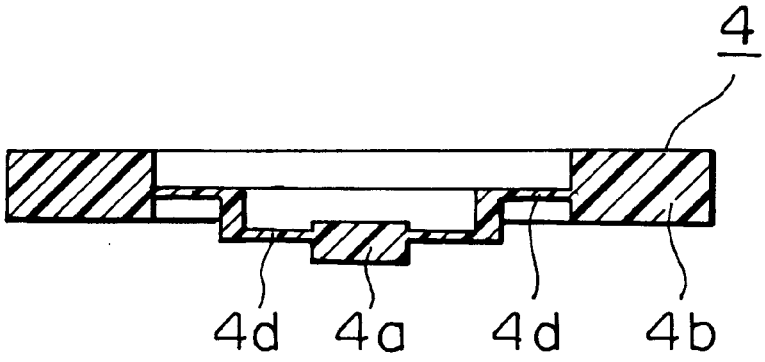
FIG. 6 is a sectional view taken along the line VI—VI of FIG. 5.

FIG. 5 is a plan view showing a modification of the driving member, and FIG. 6 is a sectional view taken along the line VI—VI of FIG. 5. In the driving member 4 shown in these drawings, the portion between the depressing portion 4*a* and the mounting portion 4*b* is formed as a thin-walled elastic portion 4*d*. When performing depressing operation, this thin-walled elastic portion 4*d* is elastically deformed, whereby an overstroke is obtained. When adopting this driving member 4, constructed as described above, a slit may be provided at an appropriate position of the elastic portion 4*d*, whereby it is possible to impart a desired flexibility to the elastic portion 4*d* even when this elastic portion is formed as a somewhat thick-walled section, which is advantageous from the viewpoint of achieving an improvement in the durability of the driving member 4.

It is not absolutely necessary for the driving member 4 to be integrally formed from a synthetic resin. It is also possible to form the elastic portion of a metal plate having resiliency, performing insert molding of synthetic resin on this metal plate. In this case, it is possible to achieve a further improvement in terms of the durability of the driving member 4.

Figure 7:
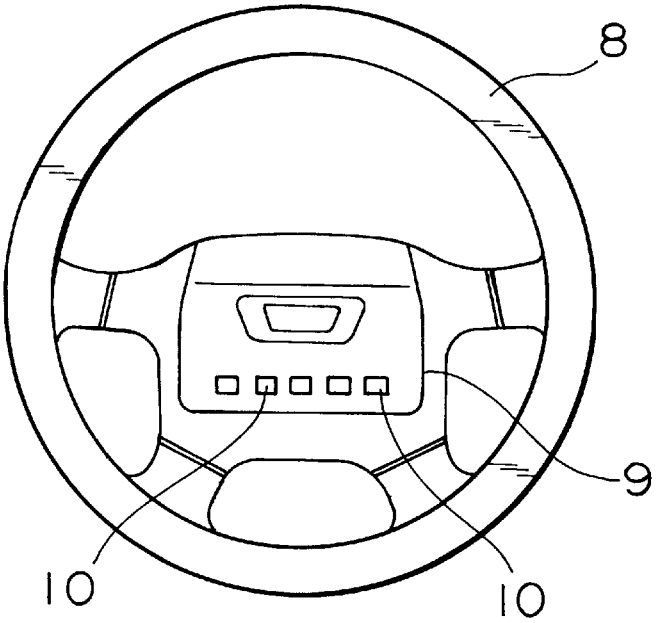
FIG. 7 is a schematic diagram illustrating an automobile steering pad to which the depression-type switch of the present invention is applied.

The depression-type switch of the present invention, described above with reference to an embodiment, can be incorporated, as indicated by numeral 10 in FIG. 7, in a steering pad 9 arranged on the inner side of a steering wheel 8 of an automobile. That is, as stated above, the thickness of the depression-type switch 10 is small, so that it can be easily incorporated in the steering pad 9, and it provides a satisfactory operating feel due to the tactile click feel and overstroke. Further, the switch is not easily liable to malfunction even when an end depressing operation is performed thereon, so that it is suitable for use as an automobile switch device. Further, a coil spring or the like, which is hard to fasten, is not used in this depression-type switch 10, and the driving member 4 and the click spring 5 are enclosed in the space defined by the sheet-like flexible member 2, the cushion member 3, and the membrane switch 6. These components are glued together to form an integral stacked body, so that, even when incorporated in the automobile steering pad 9 which is equipped with an air bag, there is no concern that components such as the driving member 4 and the click spring 5 of the depression-type switch 10 will pop out during the operation of the air bag by arranging such that the stacked body is divided by the air bag while retaining the stacked structure, thus achieving an improvement in terms of safety.

The present invention, carried out as described above, provides the following advantages:

Since the driving member for pushing in the click spring is held by holding means that is capable of elastic deformation, such as the sheet-like flexible member or the cushion member, and a part of the driving member is elastically deformed after the flipping over of the click spring, there is no need to stack together a coil spring and a rubber spring, whereby it is possible to obtain a satisfactory tactile click feel and overstroke while making it possible to easily achieve a reduction in thickness. Further, even when an end depressing operation is performed on the driving member, the holding means is pushed down integrally with the driving member in the portion where the end depression is performed, so that there is no concern that the driving member will greatly incline toward the side where the end depression is performed. Thus, the switch is not liable to malfunction even when an end depressing operation is performed, thereby achieving an improvement in terms of reliability.

Further, when the section partially connecting the depressing portion and the mounting portion is formed as an elastic portion, and this elastic portion is used as the driving member, it is possible to impart to the elastic portion a desired flexibility to effect elastic deformation for overstroke even when this elastic portion is formed as a thick-walled portion, so that the elastic portion is not liable to suffer damage even in the case of a long-term use, whereby it is possible to achieve an increase in the service life of the driving member.

Further, when the depressing portion is provided substantially at the center of the driving member, and the mounting section is provided around this depressing portion, the depressing portion is not easily inclined during depressing operation, so that there is little possibility of the click spring being obliquely pushed in, thereby achieving an increase in service life. Thus, it is possible to generate a satisfactory tactile click feel for a long period of time. Further, since the depressing portion and the mounting portion do not overlap each other as seen in plan view, it is possible to achieve a further reduction in the thickness of the depression-type switch.

What is claimed is:

1. A depression actuated switch comprising:

a holder which is elastically deformable during operation;

a driving member comprising:

a mounting portion fixed to said holder and displaced by said holder during operation from a first position to a second position;

an elastic portion connected to said mounting portion and elastically deformable during operation; and a depressing portion connected to said elastic portion and displaced by said elastic portion during operation;

a click spring arranged below said depressing portion, wherein said click spring is flipped over before a displacement of said mounting portion reaches said second position and generates a tactile click feel when flipping over; and a switch arranged below said click spring and producing an electrical conduction between contact points by said flipped over click spring;

wherein said depressing portion and said mounting portion are partially connected together to thereby form said elastic portion.

2. A depression actuated switch according to claim 1, wherein said depressing portion is provided substantially at the center of said driving member and wherein said mounting portion is provided around said depressing portion.

3. A depression actuated switch comprising:

a holder which is elastically deformable during operation;

a driving member comprising:

a mounting portion fixed to said holder and displaced by said holder during operation from a first position to a second position;

an elastic portion connected to said mounting portion and elastically deformable during operation; and a depressing portion connected to said elastic portion and displaced by said elastic portion during operation;

a click spring arranged below said depressing portion, wherein said click spring is flipped over before a displacement of said mounting portion reaches said second position and generates a tactile click feel when flipping over; and a switch arranged below said click spring and producing an electrical conduction between contact points by said flipped over click spring;

wherein a section between said depressing portion and said mounting portion is formed as a thin-walled section to thereby form said elastic portion.

4. A depression actuated switch comprising:

a holder which is elastically deformable during operation;

a driving member comprising:

a mounting portion fixed to said holder and displaced by said holder during operation from a first position to a second position;

an elastic portion connected to said mounting portion and elastically deformable during operation; and a depressing portion connected to said elastic portion and displaced by said elastic portion during operation;

a click spring arranged below said depressing portion, wherein said click spring is flipped over before a displacement of said mounting portion reaches said second position and generates a tactile click feel when flipping over; and a switch arranged below said click spring and producing an electrical conduction between contact points by said flipped over click spring;

wherein said holder comprises a sheet-like flexible member with a lower surface and a cushion member with an upper surface, wherein said lower surface is mounted to said mounting portion of said driving member and said cushion member is positioned so as to surround said driving member and said sheet-like flexible member is stacked on said upper surface of said cushion member.

5. A depression actuated switch according to claim 4, wherein said cushion member consists of a foam member that is more deformable than said sheet-like flexible member.

6. A depression actuated switch according to claim 4, wherein said switch element consists of a membrane switch.

* * * * *